US007293395B1

(12) United States Patent
Galloway et al.

(10) Patent No.: US 7,293,395 B1
(45) Date of Patent: Nov. 13, 2007

(54) APPARATUS AND METHOD FOR INSERTING CUP-SHAPED INSERTS INTO CONTAINERS

(75) Inventors: Robert Galloway, Hartsville, SC (US); James E. Gunter, Hartsville, SC (US); Mark Palmieri, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 11/425,797

(22) Filed: Jun. 22, 2006

(51) Int. Cl.

| | |
|---|---|
| ***B65B 5/00*** | (2006.01) |
| ***B65B 39/00*** | (2006.01) |
| ***B65G 47/244*** | (2006.01) |
| ***B23P 21/00*** | (2006.01) |

(52) U.S. Cl. ..... 53/473; 29/773; 53/53; 53/54; 53/55; 53/506; 53/248; 53/251; 53/255; 198/380; 198/395; 198/532

(58) Field of Classification Search ..... 53/248–251, 53/255, 142, 473, 53–55, 506; 29/407.01, 29/407.05, 407.09, 407.1, 707–709, 773, 29/801; 198/380, 395, 401, 532
See application file for complete search history.

(56) References Cited

U.S. PATENT DOCUMENTS

| | | | | | |
|---|---|---|---|---|---|
| 1,513,628 | A | | 10/1924 | Risser | |
| 2,882,658 | A | | 4/1959 | Weisman | |
| 2,959,903 | A | | 11/1960 | Lancaster | |
| 3,212,174 | A | * | 10/1965 | Wonneman | 29/709 |
| 3,276,566 | A | * | 10/1966 | Raasch | 198/395 |
| 3,388,812 | A | | 6/1968 | Cooper | |
| 3,535,847 | A | * | 10/1970 | Pernkopf et al. | 53/501 |
| 3,741,366 | A | | 6/1973 | Van Melle et al. | |
| 3,788,029 | A | * | 1/1974 | Pokorney | 53/501 |
| 3,815,321 | A | | 6/1974 | Hartman | |
| 3,856,131 | A | | 12/1974 | Flamand et al. | |
| 4,019,547 | A | * | 4/1977 | Ross | 141/11 |
| 4,054,015 | A | * | 10/1977 | Rowell | 53/446 |
| 4,068,450 | A | | 1/1978 | Easter | |
| 4,135,616 | A | * | 1/1979 | Pellaton | 198/418.9 |
| 4,189,898 | A | | 2/1980 | Moulds et al. | |
| 4,220,238 | A | | 9/1980 | Shavit | |
| 4,226,073 | A | * | 10/1980 | Rose et al. | 53/532 |
| 4,526,128 | A | | 7/1985 | Sorace et al. | |
| 4,955,178 | A | * | 9/1990 | Shroyer | 53/148 |
| 5,117,614 | A | * | 6/1992 | Johnsen | 53/540 |
| 5,193,329 | A | | 3/1993 | Loffredo et al. | |

(Continued)

*Primary Examiner*—Stephen F. Gerrity
(74) *Attorney, Agent, or Firm*—Alston & Bird LLP

(57) ABSTRACT

An apparatus and method for producing container assemblies having a cup-shaped insert disposed within a container. A container conveyor conveys a series of open containers along a lower horizontal path, the container conveyor bringing each container in turn to a stop at an insertion station. A generally vertical inserter chute is disposed above the insertion station for conducting a generally cup-shaped insert through the inserter and out the lower end into a container positioned at the insertion station. An insert conveyor disposed above the inserter conveys a series of inserts along an upper horizontal path, each insert on the insert conveyor having an open end and an opposite closed end and being in an inverted orientation such that the open end of the insert faces downward. A lead one of the inserts being conveyed on the insert conveyor tips over and falls into the inserter in an upright orientation.

23 Claims, 4 Drawing Sheets

U.S. PATENT DOCUMENTS 5,348,133 A * 9/1994 Powell et al. ..... 198/380
5,353,913 A * 10/1994 Steiger et al. ..... 198/418.6
5,426,930 A * 6/1995 Badiali et al. ..... 57/281
5,755,318 A 5/1998 Zikeli et al.
5,888,046 A 3/1999 Salda et al.
6,178,753 B1 1/2001 Scudder et al.
6,266,879 B1 7/2001 Scudder et al.
6,351,953 B1 3/2002 Scudder et al.
2005/0229548 A1 10/2005 Hooper

* cited by examiner

APPARATUS AND METHOD FOR INSERTING CUP-SHAPED INSERTS INTO CONTAINERS

BACKGROUND OF THE INVENTION

The invention relates generally to an apparatus and method for producing container assemblies, and more particularly to an apparatus and method for inserting cup-shaped inserts into containers.

At times there is a desire to produce a container assembly that provides two separate compartments in a container for containing two different types of contents that must remain separated. This can be accomplished, for example, by inserting a cup-shaped or cone-shaped insert into an open end of a tubular container and sealing the open end of the insert to the open end of the container. In this manner, the interior of the insert defines a first compartment for containing one type of material, and the interior volume of the container surrounding the insert defines a second compartment for containing another type of material. A closure can be affixed to the open end of the insert to seal the first compartment closed, and another closure can be affixed to the opposite end of the container to seal the second compartment closed.

As an example, one application of such a dual-compartment container is in self-heating or self-cooling containers of the type exemplified by U.S. Pat. Nos. 6,178,753, 6,266,879, and 6,351,953 to Scudder et al. The cup-shaped insert in such containers holds a first chemical reactant that, when mixed with a second reactant, undergoes an exothermic or endothermic reaction so as to heat or cool the contents of the container. The closure for the cup-shaped insert includes a space filled with the second reactant, and a frangible barrier that separates the space from the first reactant in the insert. The frangible barrier can be broken by pushing down on a portion of the closure, thereby releasing the second reactant into the insert to mix with the first reactant and initiate the exothermic or endothermic reaction.

It is desirable to automate the insertion of the cup-shaped inserts into the containers in a cost-effective, reliable fashion.

BRIEF SUMMARY OF THE INVENTION

The present invention addresses the above needs and achieves other advantages by providing an apparatus and method for producing container assemblies having a cup-shaped insert disposed within a container. The apparatus in one embodiment of the invention comprises a container conveyor structured and arranged to convey a series of open containers along a lower horizontal path, each container having an open top end facing upward, the container conveyor bringing each container in turn to a stop at an insertion station located along the lower horizontal path. A generally vertical inserter is disposed above the insertion station, the inserter having an upper end and a lower end and an internal passage extending between the upper and lower ends for conducting a generally cup-shaped insert through the inserter and out the lower end into a container positioned at the insertion station. The apparatus includes an insert conveyor disposed above the inserter and structured and arranged to convey a series of inserts along an upper horizontal path, each insert on the insert conveyor having an open end and an opposite closed end and being in an inverted orientation such that the open end of the insert faces downward. The insert conveyor and inserter are structured and arranged such that a lead one of the inserts being conveyed on the insert conveyor tips over and falls into the inserter in an upright orientation.

The insert conveyor in one embodiment includes a self-timing wheel that acts generally as a turnstile. The self-timing wheel is located adjacent the downstream end of the insert conveyor at the point where the lead insert tips over into the inserter. The wheel helps prevent shingling, interlocking, and/or jamming of inserts at the tip-over point.

In one embodiment, the apparatus includes a tip-over mechanism to encourage the lead insert to tip over into the inserter. The tip-over mechanism can include an air nozzle for delivering a blast of air against the lead insert to cause the insert to tip over. The tip-over mechanism can also include a solenoid valve or the like that is activated to supply pressurized air to the air nozzle in response to a signal from a detector positioned to detect when an insert is in proper position to be tipped over into the inserter.

An insertion mechanism is coupled with the inserter and is structured and arranged to be controllably moved from a blocking position wherein the insertion mechanism prevents the insert from exiting through the lower end of the inserter, and a release position wherein the insert is allowed to move through the lower end of the inserter into a container at the insertion station. A controller coordinates operation of the container conveyor, the insert conveyor, and the insertion mechanism such that each insert delivered into the inserter is held therein until a container is moved by the container conveyor to the insertion station, whereupon the insertion mechanism allows the insert to move into the container to form a container assembly.

The apparatus can include a sensor for detecting a jam in the inserter. When a jam is detected, the apparatus can be stopped momentarily until the jam is cleared.

In one embodiment, the apparatus includes a container sensor system coupled with the controller and operable to detect a missing container condition in the container conveyor. The controller is operable, in response to detection of the missing container condition, to interrupt operation of the insert conveyor and the insertion mechanism until the missing container condition has been rectified.

The apparatus additionally or alternatively can include an insert sensor system coupled with the controller and operable to detect an abnormally positioned insert on the insert conveyor, and an insert removal device coupled with the controller and operable to remove the abnormally positioned insert from the insert conveyor. The controller is operable, in response to detection of the abnormally positioned insert, to operate the insert removal device to remove the abnormally positioned insert before it becomes the lead insert of the series. In one embodiment, the insert removal device can comprise an air nozzle that directs a jet of air against the abnormally positioned insert to knock it off the insert conveyor.

The apparatus in accordance with one embodiment of the invention further comprises a container assembly sensor system coupled with the controller and operable to detect any unsatisfactory container assembly in the container conveyor downstream of the insertion station. An unsatisfactory container assembly is one that either is missing an insert or has an improperly positioned insert. A container assembly removal device is coupled with the controller and operable to remove an unsatisfactory container assembly from the container conveyor. The controller is operable, in response to detection of an unsatisfactory container assembly, to operate the container assembly removal device to remove the unsatisfactory container assembly from the container conveyor such that the unsatisfactory container assembly is prevented from advancing to a further downstream process for the container assemblies.

The container conveyor in one embodiment comprises a horizontal support plate upon which the containers are supported and advanced along, a container guide member positioned above the support plate and extending along the lower horizontal path, and a feed screw adjacent and parallel to the container guide member. The feed screw has helical flights such that a series of container-receiving pockets are defined between the helical flights and the container guide member, the feed screw being rotatably driven such that containers disposed in the container-receiving pockets are advanced by the feed screw along the lower horizontal path to and past the insertion station.

The helical flights of the feed screw can include a dwell portion configured to cause a container being advanced along the lower horizontal path to momentarily come to a stop at the insertion station for a predetermined period of time and then begin advancing again along the lower horizontal path while the feed screw continuously rotates.

The insert conveyor likewise can comprise a feed screw in one embodiment.

The inserter can include a first aperture through a side wall of the inserter into the internal passage, and the insertion mechanism can comprise a first member that in the blocking position is extended through the first aperture into the internal passage to prevent an insert from exiting the lower end of the inserter, and in the release position is retracted from the internal passage to allow the insert to exit the inserter. The first member can be moved by a first pneumatic cylinder. Preferably, the inserter also includes a second aperture opposite from the first aperture, and a second member that is extendable and retractable through the second opening in unison with the first member. A second pneumatic cylinder is arranged to move the second member.

At the beginning of a cycle for producing a container assembly, the pneumatic cylinders are actuated to extend the members into the internal passage of the inserter in preparation for the delivery of an insert from the insert conveyor into the inserter. The insert conveyor advances the inserts along the upper horizontal path until the lead insert is caused to tip over and fall into the inserter. The members block the insert from passing through the inserter and detain the insert until the container conveyor has brought a container to a stop at the insertion station. The pneumatic cylinders are then actuated to retract the members so that the insert falls by gravity through the lower end of the inserter into the container to form a container assembly. The container conveyor then advances the container assembly downstream and the process is repeated for each container in turn.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
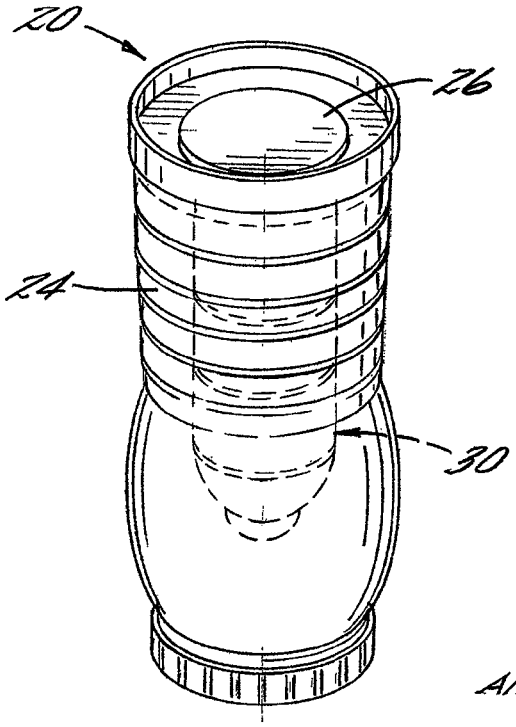
FIG. 1 is a perspective view of a container and insert assembly produced by the apparatus and method of the invention.
Figure 2:
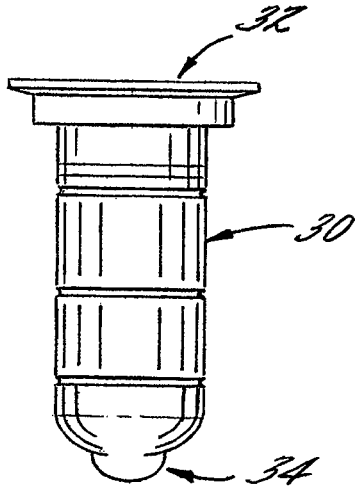
FIG. 2 is a side elevation of the insert that forms part of the container and insert assembly of FIG. 1.

With reference to FIGS. 1 and 2, these figures respectively show a container and insert assembly 20 of the type to which the present invention is addressed, and an insert 30 that forms part of the assembly 20. The assembly 20 is useful, for example, in the production of a dual-compartment container such as a self-heating or self-cooling container of the type exemplified by U.S. Pat. Nos. 6,178,753, 6,266,879, and 6,351,953 to Scudder et al., the disclosures of which are incorporated herein by reference. The assembly 20 comprises a container 24 that is open at its top and bottom ends, and an insert 30 concentrically disposed within the container 24. It should be noted that the terms "top" and "bottom" as applied to the container 24 and insert 30 refer to the orientation as shown in FIG. 1. It will be understood that when the assembly 20 is used in a dual-compartment container such as described in the aforementioned '753, '879, and '953 patents, the "top" end in FIG. 1 ultimately becomes the bottom end of the dual-compartment container, as illustrated in FIG. 3 of the '753 patent.

The insert 30 is generally tubular in configuration with an open top end 32 and a closed bottom end 34. The insert thus has a generally cup- or cone-shaped configuration. The outside diameter of the insert is generally smaller than the inside diameter of the container such that there is an annular space therebetween when the insert is inserted into the container, as illustrated in FIG. 1. The top end 32 of the insert and the top end of the container 24 are configured such that an outer peripheral portion of the insert's top end engages an surface of the container so as to limit how far the insert can be inserted into the container. When used as part of a self-heating container as noted above, the insert 30 is filled with a material such as quick lime that undergoes an exothermic reaction when mixed with water, and then the insert is sealed closed with a component that includes a sealed "puck" or compartment 26 (FIG. 1) containing water. There is a frangible membrane separating the sealed compartment 26 from the quick lime in the insert 30. The user can press on a button to cause the frangible membrane to break and release the water into the quick lime, thus starting the exothermic reaction. The liquid contents in the container 24 surrounding the insert 30 are heated to a desired temperature in this manner. The self-heating container can be used for a hot beverage such as coffee or cocoa.

The objective of the apparatus and process of the invention is to automate the process of inserting inserts 30 into containers 24 to form assemblies 20. The assemblies 20 are then subjected to further operations by subsequent machines and/or by workers.

Figure 3:
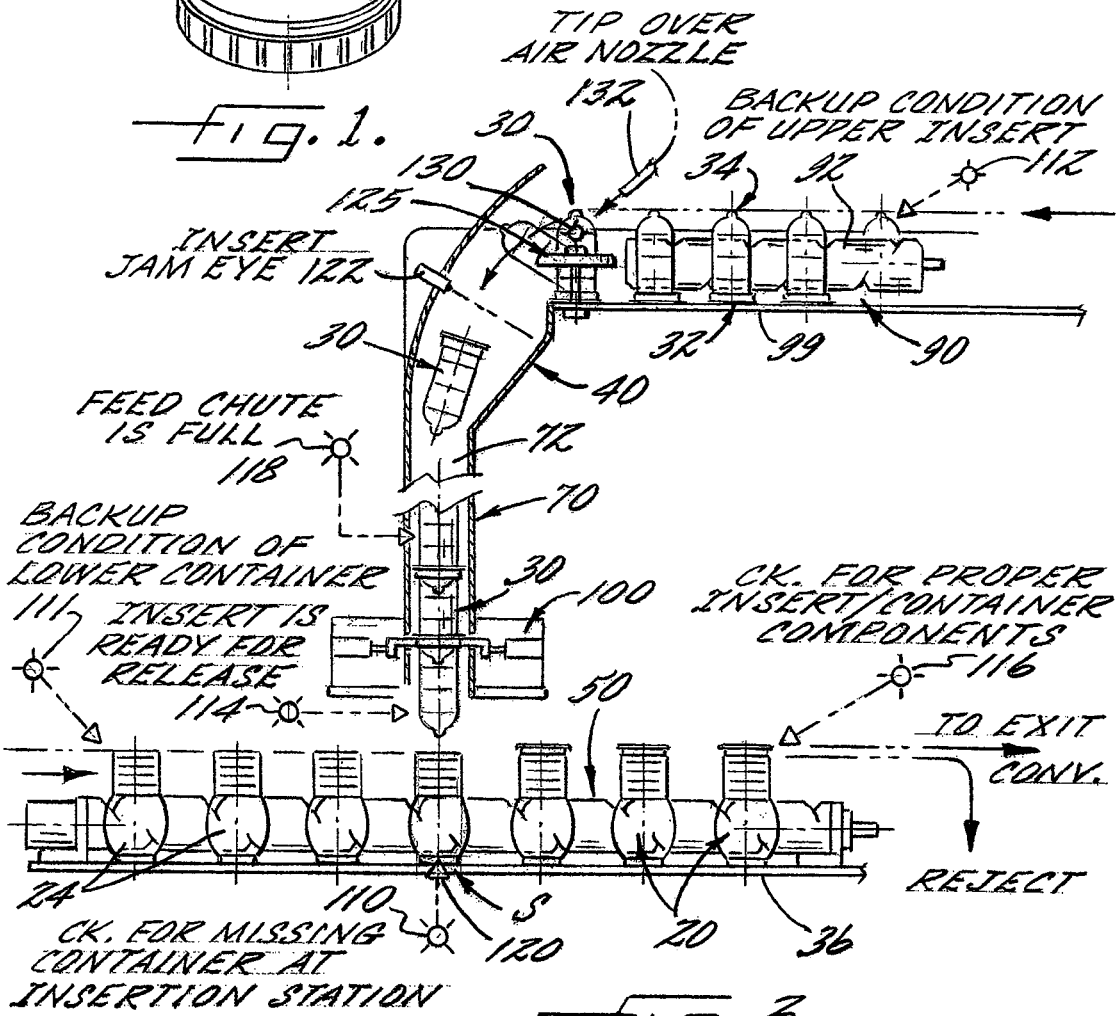
FIG. 3 is a diagrammatic side elevation of an apparatus for making container and insert assemblies in accordance with one embodiment of the invention.

FIG. 3 schematically illustrates an apparatus and method in accordance with one embodiment of the invention for forming assemblies 20 automatically. The apparatus 40 comprises a container conveyor 50 structured and arranged to convey a series of open containers 24 along a lower horizontal path, each container having its open top end facing upward, the container conveyor further structured and arranged to momentarily bring each container in turn to a stop at an insertion station S located along the lower horizontal path. The apparatus includes a container conveyor drive operable to drive the container conveyor, such as a motor 54 as described in connection with FIG. 5 below. The apparatus also includes a generally vertical inserter 70 disposed above the insertion station S, the inserter having an upper end and a lower end and an internal passage 72 extending between the upper and lower ends for conducting the inserts 30 through the inserter and out the lower end into a container 24 positioned at the insertion station S.

The apparatus 40 further comprises an insert conveyor 90 disposed above the inserter 70 and structured and arranged to convey a series of inserts 30 along an upper horizontal path, each insert on the insert conveyor being in an inverted orientation such that the open end 32 of the insert faces downward. The insert conveyor 90 and inserter 70 are structured and arranged such that a lead one of the inserts 30 being conveyed on the insert conveyor 90 is tipped over and falls by gravity into the inserter 70 in an upright orientation, as illustrated in FIG. 3. The insert conveyor includes an insert conveyor drive operable to drive the insert conveyor. The insert conveyor drive can comprise the motor 54 and a mechanical linkage coupling the insert conveyor 90 to the motor, as described below in connection with FIGS. 7 and 8.

The apparatus further includes an insertion mechanism 100 coupled with the inserter 70 and structured and arranged to be controllably moved from a blocking position wherein the insertion mechanism prevents an insert 30 from exiting through the lower end of the inserter, and a release position wherein the insert 30 is allowed to fall by gravity through the lower end of the inserter into a container 24 at the insertion station S. The operation of the insertion mechanism 100 is described in detail below in connection with FIG. 11.

The apparatus 40 also employs a controller 200 (FIG. 4) coupled with and coordinating operation of the container conveyor drive, the insert conveyor drive, and the insertion mechanism 100 such that each insert 30 delivered into the inserter 70 is held therein until a container 24 is moved by the container conveyor 50 to the insertion station S, whereupon the insertion mechanism 100 allows the insert 30 to fall into the container 24 to form a container assembly 20. The controller can be a PC, a programmable logic controller (PLC), or any other suitable controller that can execute a set of instructions for controlling the various components of the apparatus.

The above description provides an overview of the apparatus and method in accordance with one embodiment of the invention. The apparatus and method are now described in further detail with reference to FIGS. 4 through 12.

Figures 4, 5, 6, 6A:
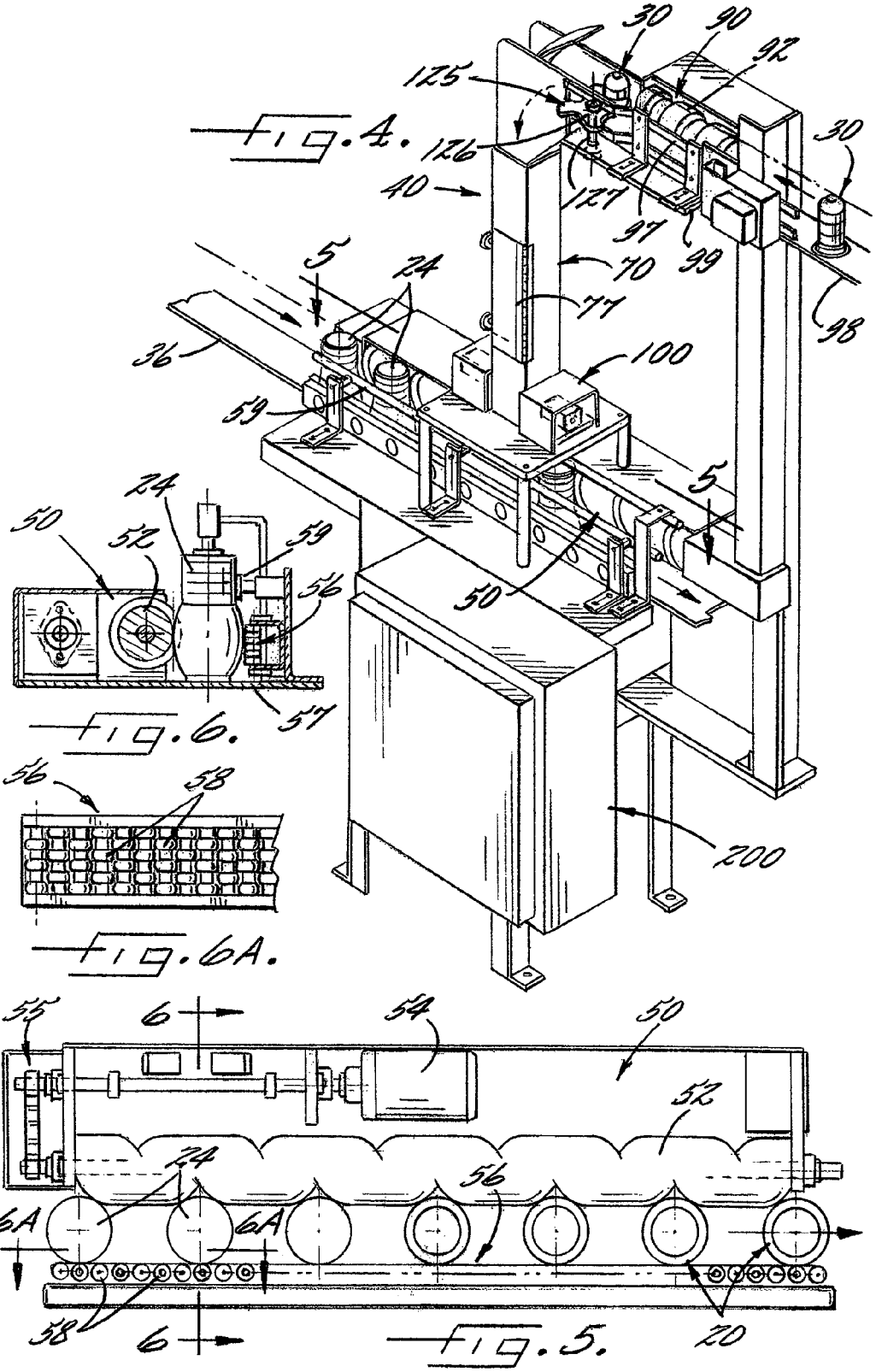
FIG. 4 is a perspective view of an apparatus in accordance with one embodiment of the invention.
FIG. 5 is a view along line 5-5 in FIG. 4.
FIG. 6 is a cross-sectional view along line 6-6 in FIG. 5.
FIG. 6A is a cross-sectional view along line 6A-6A in FIG. 5.

FIG. 4 illustrates the apparatus 40 in accordance with one embodiment. A series of containers 24 are advanced by a suitable infeed conveyor 36 to an inlet side of the container conveyor 50. The container conveyor 50 and its associated drive are illustrated in detail in FIGS. 5, 6, and 6A. The container conveyor in one embodiment comprises a feed screw 52 defining helical flights at its outer surface for engaging containers 24. The feed screw is rotatably driven by a motor 54 coupled to the feed screw directly or through a suitable linkage 55 as shown in FIG. 5. The feed screw is spaced from a rail 56 that extends parallel to the feed screw such that containers 24 are captive between the feed screw and the rail and reside in the pockets of the feed screw formed by the helical flights. Accordingly, rotation of the feed screw causes the containers received from the infeed conveyor to be advanced along the rail 56, the containers being supported on a support plate 57 that extends horizontally beneath the feed screw. As illustrated, the rail 56 can comprise a series of roller elements 58 that can freely rotate about vertical axes as the container 24 is advanced by the feed screw. The feed screw 52 and rail 56 can be configured and positioned to engage the containers 24 at their largest-diameter portions, which can be located at a lower position along the height of the containers, as shown in FIG. 6. The rail 56 can further comprise an upper guide member 59 for engaging each container at a higher position along its height to stabilize the containers against tipping so they remain substantially upright as they are conveyed.

As noted above in connection with FIG. 3, the apparatus 40 includes an insertion station S at which the inserts 30 are inserted into the container 24. With further reference to FIG. 5, the feed screw 52 is configured at its outer surface so that each container 24 is momentarily brought to a halt at the insertion station S for receiving an insert. This can be accomplished by configuring a part of the helical flights at the desired location along the length of the feed screw to include a "dwell" portion (not shown) that extends circumferentially without any axial component for a predetermined fraction of a full 360° rotation of the screw. Accordingly, when a container reaches the dwell portion, the container remains stationary for the amount of time required for the screw to rotate by the predetermined fraction of 360°. The dwell portion is overlapped by the next succeeding helical flight such that as the screw continues to rotate, the succeeding helical flight engages the container and begins to advance it again. It is also possible to configure the helical flights with a varying pitch along the length of the screw in order to decelerate the containers up to the insertion station, and to gradually accelerate them away from the insertion station. Such screw feed conveyors with dwell and variable-pitch features are known in the art (see, for example, U.S. Pat. No. 4,526,128, the disclosure of which is incorporated herein by reference) and thus the detailed design of the feed screw 52 is not further described herein.

At the discharge end of the container conveyor 50, the container assemblies 20 can be discharged onto an exit conveyor (not shown) for conveying the assemblies to a further processing station.

Figure 8:
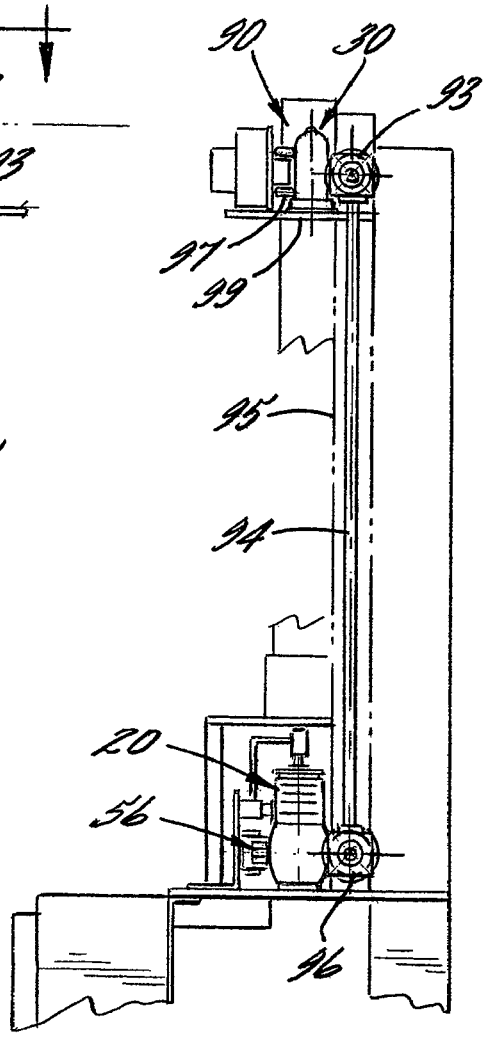
FIG. 8 is a cross-sectional view along line 8-8 in FIG. 7.
Figure 9:
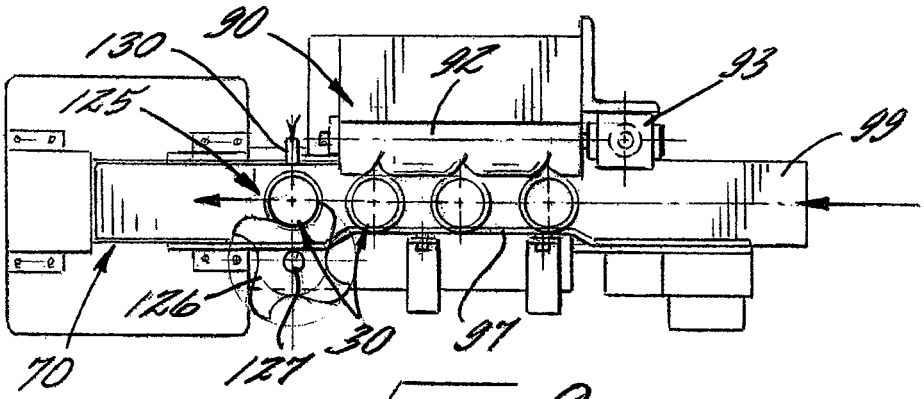
FIG. 9 is a top view along line 9-9 in FIG. 7.

The insert conveyor 90 and its associated drive are now described with reference to FIGS. 7 through 9. The insert conveyor comprises a feed screw 92 defining helical flights at its outer surface for engaging inserts 30. The feed screw 92 is rotatably driven by the output of a right-angle gearbox 93. The input of the gearbox 93 is coupled to a vertical shaft 94 that extends up through a hollow vertical column 95 affixed to the apparatus frame (FIG. 4). The shaft 94 is connected to the output of another right-angle gearbox 96 whose input is connected to the feed screw 52 of the container conveyor 50. Thus, the drive motor 54 for the container conveyor also drives the insert conveyor 90 via the linkage of the gearboxes 93, 96 and the shaft 94. The feed screw 92 is spaced from a rail 97 that extends parallel to the feed screw such that inserts 30 are captive between the feed screw and the rail and reside in the pockets of the feed screw formed by the helical flights. Accordingly, rotation of the feed screw 92 causes the inserts received from a suitable infeed conveyor 98 (FIG. 4) to be advanced along the rail 97, the inserts being supported on a support plate 99 that extends horizontally beneath the feed screw.

Figure 10:
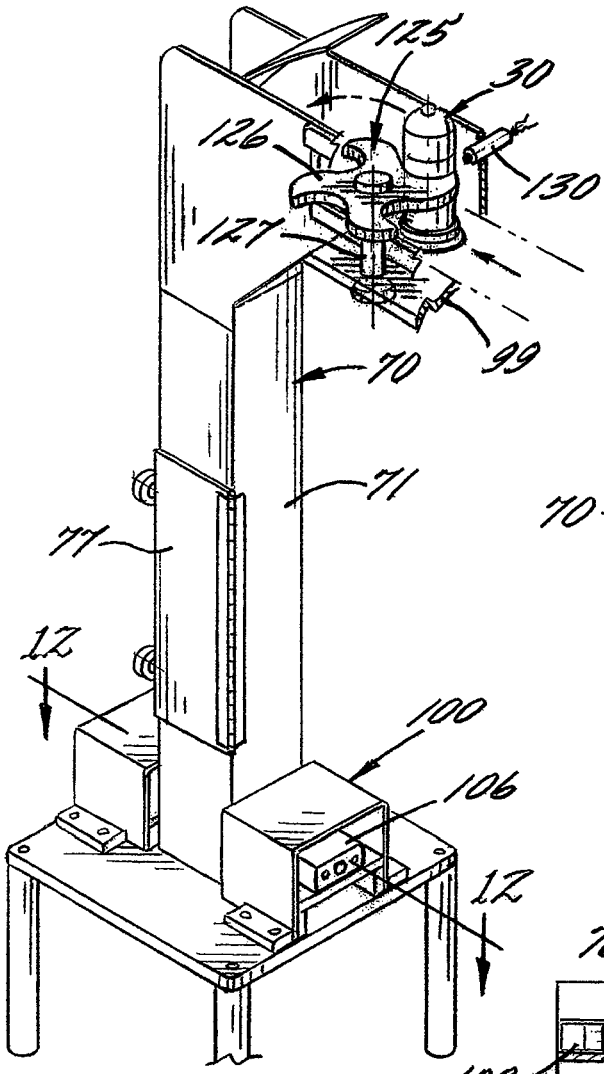
FIG. 10 is a perspective view of a feed chute and insertion mechanism assembly of the apparatus of FIG. 4.

As noted above, the inserts 30 conveyed by the insert conveyor 90 are oriented with their closed ends up and their open ends down, which is upside down relative to the orientation in which the inserts are to be received into the containers 24. The lead insert on the insert conveyor engages a self-timing star wheel mechanism 125 that serves to prevent the inserts from shingling, interlocking, and/or jamming at the tip-over point. The star-wheel mechanism is seen in FIG. 10 to comprise a star wheel 126 mounted for free rotation about a vertical shaft 127 affixed to the support plate 99 of the insert conveyor. The star wheel includes a plurality of radially outwardly extending arms spaced about its circumference. Each of the spaces between adjacent arms is configured for receiving an insert. The star wheel effectively acts like a turnstile to enforce a certain amount of separation between the inserts being conveyed to the tip-over point. If the flanges of the inserts were to become shingled or interlocked at the tip-over point, the lead insert may not properly tip over. The star wheel prevents the inserts from shingling, interlocking, or jamming at the tip-over point.

Figure 7:
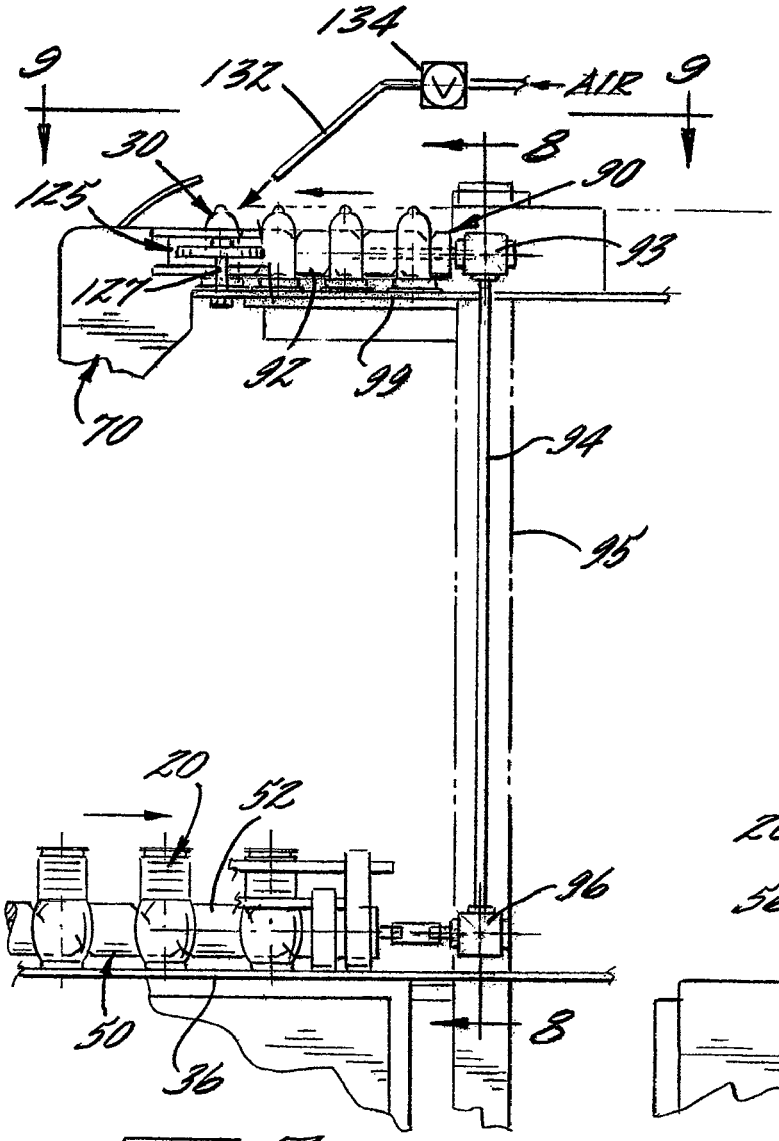
FIG. 7 is a fragmentary side elevation, partially broken away, showing a portion of the apparatus of FIG. 4.
Figure 11:
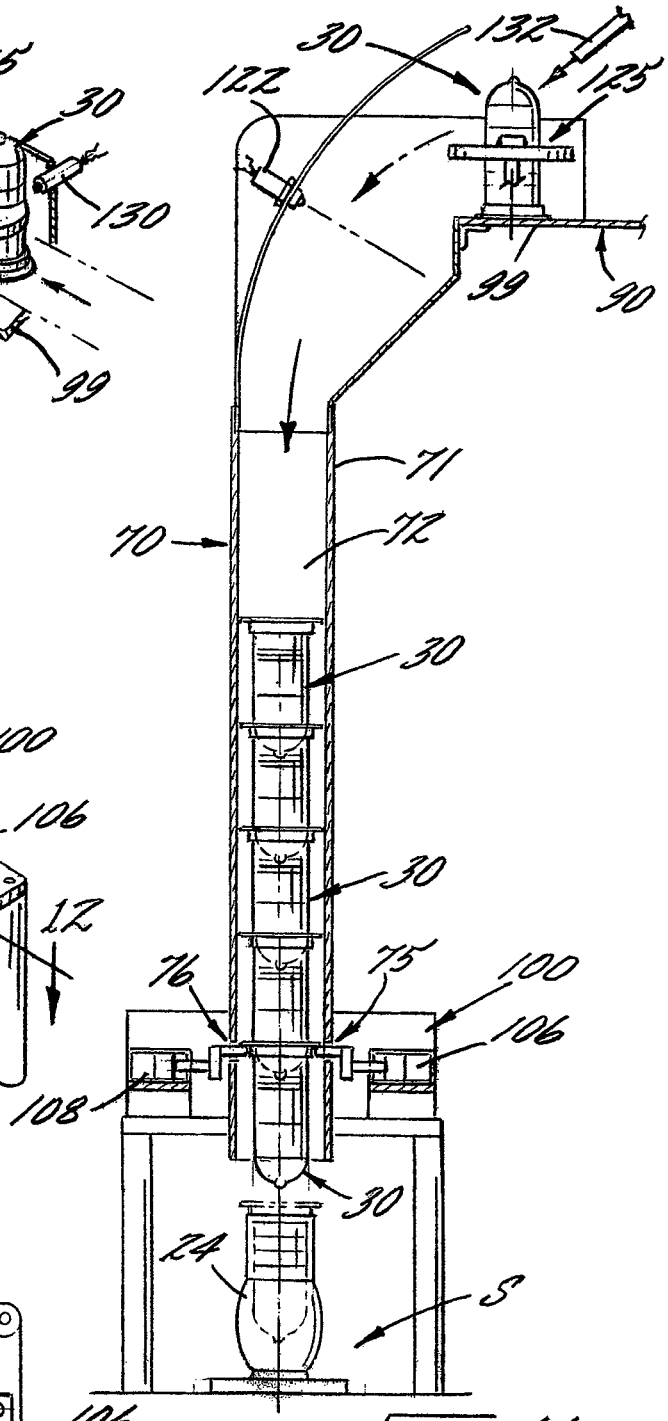
FIG. 11 is a side elevation, partly in section, of the feed chute and insertion mechanism assembly of FIG. 10.

As illustrated particularly in FIGS. 7, 10, and 11, at the tip-over point the apparatus includes an air nozzle 132 for delivering a blast of air against the lead insert that has just exited the star wheel 125. The blast of air causes the insert to tip over and fall into the inserter 70 for insertion into a container. The apparatus includes a detector 130 for detecting when an insert is properly in position at the tip-over point. When an insert is detected at the tip-over point, a solenoid valve 134 or the like is activated to open momentarily and connect the air nozzle 132 with a pressurized air source so that a blast of air is directed against the insert to tip it over, after which the solenoid valve is closed until the next insert is to be tipped over.

In some cases (e.g., where the inverted inserts 30 on the insert conveyor 90 are quite top-heavy and thus prone to easily tip over), the air nozzle 132 and associated components may not be necessary to tip the inserts over. In such cases, a simple trip bar (not shown) may be sufficient to cause the lead insert to tip over into the inserter 70. The trip bar could operate in conjunction with the star wheel 125 or without the star wheel.

Figure 12:
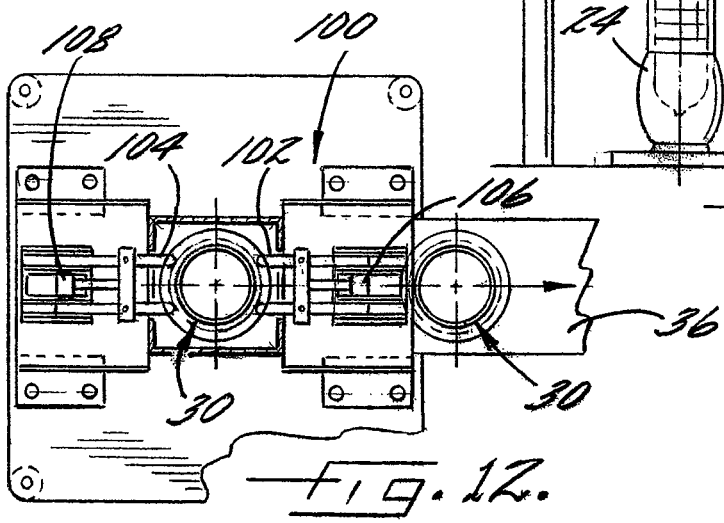
FIG. 12 is a cross-sectional view along line 12-12 in FIG. 10.

The inserter 70 and the insertion mechanism 100 are now described with reference to FIGS. 10 through 12. The inserter 70 comprises a vertical feed chute 71 defining an internal passage 72 for the inserts 30 to fall freely through under the influence of gravity. The internal passage 72 is only slightly larger than the largest diameter of the inserts 30 such that the inserts remain upright and are not free to change orientation (i.e., from upside down to right side up, or vice versa) as they fall through the chute. The upper end of the feed chute 71 has an enlarged funnel portion 73 that is open toward the discharge end of the insert conveyor 90. At the discharge end of the insert conveyor, which substantially coincides with the entrance to the funnel portion 73, the tip-over mechanism is operated to cause the lead insert to tip over and fall into the funnel portion 73 in a right side up orientation (see FIG. 3). The funnel portion 73 leads into the vertical feed chute 71 as shown in FIG. 11.

The insertion mechanism 100 is operable to regulate the passage of the inserts 30 through the lower end of the feed chute 71 into the containers 24 positioned at the insertion station S. In particular, it is necessary to synchronize the feeding of the inserts from the lower end of the chute 71 with the movement of the containers 24 by the insert conveyor such that a container 24 is stationary at the insertion station S at the moment when an insert 30 is released from the chute 71. The insertion mechanism 100 is operable to allow such synchronized feeding of the inserts.

The feed chute 71 of the inserter includes a first aperture 75 through a side wall of the chute into the internal passage 72. The insertion mechanism 100 comprises a first member 102 that extends through the first aperture 75 and is slidable between a blocking position and a release position. In the blocking position as shown in FIGS. 11 and 12, the first member 102 is extended through the first aperture 75 into the internal passage 72 sufficiently to prevent engage an insert 30 and prevent it from exiting the lower end of the chute 71. In the release position, the first member 102 is retracted from the internal passage 72 to allow the insert 30 to fall through the lower end of the chute 71. The insertion mechanism preferably also includes a second member 104 that extends through a second aperture 76 in the chute 71 opposite from the first aperture 75 and is slidable between blocking and release positions. In the blocking positions of the members 102, 104, the members engage the insert 30 at diametrically opposite positions so that the insert is held in an upright orientation until it is time to release the insert into a container.

The first member 102 is connected with a first actuator 106, such as a pneumatic cylinder or the like, for advancing and retracting the first member. Likewise, the second member 104 is connected with a second actuator 108, such as a pneumatic cylinder or the like, for advancing and retracting the second member. When the actuators 106, 108 comprise pneumatic cylinders, they are connected with suitable air supply lines (not shown) and controllable valves (not shown) for controlling the supply of pressurized air to the pneumatic cylinders to cause the cylinders to advance or retract the respective members 102, 104. The cylinders can be single-acting or double-acting cylinders. Alternatively, the actuators 106, 108 can be other types of devices such as solenoids. The operation of the actuators is controlled in synchronism with the movement of the containers by the container conveyor so that the members 102, 104 are retracted to release an insert 30 only when a container is positioned at the insertion station S, as previously noted.

As shown in FIG. 1, the feed chute 71 can accommodate a plurality of inserts 30 in a vertical stack. The insertion mechanism 100 engages the lowest insert in the stack. When the actuators 106, 108 are operated to retract the members 102, 104 to release the lowest insert, the other inserts also fall downwardly. The members 102, 104 are retracted only long enough to allow the lowest insert to pass by, and are then quickly advanced back to the blocking position to catch the next insert, so that only one insert is released at a time.

As described above, the force for moving an insert 30 into a container 24 at the insertion station S can be provided by gravity alone. However, in some cases it may be desirable to augment the force of gravity so as to move the insert into the container more quickly such that the production rate of the apparatus can be increased. Toward this end, as illustrated in FIG. 3, the apparatus can include an aperture through the support plate 57 at the insertion station S, and a vacuum source 120 can be connected with the aperture for exerting vacuum through the aperture and, hence, through the interior of the open-ended container 24. In this manner, the vacuum can exert a suction force on the insert 30 as it moves into the top end of the container, thus pulling the insert into the container at a faster rate than possible with gravity alone. It is also possible to use a blast of compressed air directed against the insert from above to push the insert into the container.

With reference again to FIG. 3, the apparatus 40 can include various sensors for detecting certain conditions in the apparatus and taking certain actions based on the sensors' outputs. For example, the apparatus can include a container sensor 110 coupled with the controller 200 (FIG. 4) and operable to detect a missing container condition in the container conveyor 50. The controller can be programmed to be operable, in response to detection of a missing container condition, to interrupt operation of the insert conveyor 50 and the insertion mechanism 100 until the missing container condition has been rectified. Additionally or alternatively, a sensor 111 located at the infeed side of the container conveyor 50 can check for a missing container condition coming into the container conveyor. If the sensor 111 detects a missing container condition, the container conveyor can be halted until the condition is rectified.

Furthermore, the apparatus can include an insert sensor 112 coupled with the controller and operable to detect an abnormally positioned insert 30 on the insert conveyor 90. The apparatus can include an insert removal device coupled with the controller and operable to remove the abnormally positioned insert from the insert conveyor. For example, the insert removal device can comprise an air nozzle for directing a blast of high-velocity air against the abnormally positioned insert to knock it off the conveyor into a reject bin or the like. The controller can be programmed to be operable, in response to detection of the abnormally positioned insert, to operate the insert removal device to remove the abnormally positioned insert before the insert becomes the lead insert of the series on the insert conveyor.

The apparatus can also include a sensor 114 for detecting the presence or absence of an insert 30 engaged by the insertion mechanism 100 and ready to be released into a container. If the sensor 114 detects that no insert is present, then the operation of the container conveyor 50 can be halted until the missing insert condition is rectified.

Additionally, the apparatus can include a sensor 116 for detecting whether or not the containers 24 leaving the insertion station S include a properly inserted insert 30. If the sensor 116 detects a missing insert or an improperly positioned insert, the unacceptable container assembly can be rejected such as by knocking it off the conveyor with a blast of air from an air nozzle, or by other means. The rejected container assembly can be diverted into a reject bin or the like.

Furthermore, the apparatus can include a sensor 118 for detecting whether or not the feed chute 71 is "full", i.e., whether a predetermined number of inserts 30 are stacked up within the chute waiting to be released into containers. For instance, it may be desirable to always have no more than a certain number inserts stacked up in the chute above the lowest insert that is next to be released into a container. If the sensor 118 detects that there are more than this number of inserts in the queue above the lowest insert, then an alarm can be provided to an operator so that the condition can be investigated to determine whether corrective action needs to be taken. It is also possible to have the corrective action taken automatically by the controller. As shown in FIG. 10, the feed chute 71 can include a door 77 that can be opened by an operator to gain access to the internal passage of the chute for rectifying an abnormal condition. It is also possible to provide a portion of the feed chute to be transparent so that the inserts in the chute can be viewed without having to open the door 77. For example, the door 77 can be transparent.

The inserter can also include a jam detector 122 (FIGS. 3, 11) positioned near the upper end of the chute 71 for detecting prolonged presence of an insert at the upper end, which is indicative of a jam in the chute. The jam can be caused, for example, by a defective insert (e.g., having abnormal flashing from a molding operation) that impedes free falling of the insert through the chute. If the jam detector 122 detects an insert present in the upper end for too long a period of time (i.e., longer than it normally takes for an insert to pass by the jam detector when freely falling), the apparatus can be stopped to allow an operator to investigate and clear the jam, if necessary. The jam detector can be mounted on the far wall of the chute 71 across from the insert conveyor 90 and can look down toward the opposite near wall at an acute angle of declination (such as about 45 degrees declination) such that the line of sight of the detector is generally perpendicular to the axis of the insert passing by.

With primary reference to FIGS. 3 through 5, in operation, a supply of inserts 30 is conveyed by the infeed conveyor 98 to the insert conveyor 90, and a supply of containers 24 is conveyed by the infeed conveyor 36 to the container conveyor 50. The motor 54 is operated by the controller 200 to rotate the container feed screw 52, and the insert feed screw 92 is also rotated by its connection with the container conveyor feed screw 52. The rates of rotation of the feed screws 52, 92 are governed by the speed of the motor 54 as controlled by the controller 200, and the relative rates of rotation of the two screws are dictated by the particular designs of the linkage 55 and the gearboxes 93, 96 (FIG. 7). Advantageously, the screws rotate at rates that ensure that inserts 30 are delivered by the insert conveyor feed screw 92 at the same rate as containers 24 are moved to the insertion station S by the container conveyor feed screw 52. The controller 200 is able to regulate the rotation rate of the motor 54 and thus of the screws 52, 92 for increasing or decreasing the production rate of the apparatus, and is able to stop the motor 54 when necessary, such as when an abnormal condition is detected by any of the various sensors as described above.

A given container 24 is advanced by the feed screw 52 to the insertion station S, where the container is brought to a halt for a predetermined period of time by virtue of the dwell feature of the screw 52. Meanwhile, an insert 30 has been delivered by the insert conveyor feed screw 92 into the inserter 70 and has been caught by the members 102, 104 (FIG. 11) of the insertion mechanism 100 and retained in the feed chute 71 ready to be released into the container. Just as the container 24 comes to a halt at the insertion station S, the insertion mechanism is activated by the controller to retract the members 102, 104 so as to release the insert 30 into the waiting container 24 and to advance again to catch the next insert. As the container feed screw 52 continues to rotate throughout this process, the assembly 20 of the container 24 and insert 30 is advanced away from the insertion station toward a suitable exit conveyor or other station. The other station may be, for example, a spin-welding machine that spin-welds the insert 30 to the container 24.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for producing container assemblies, comprising:

a container conveyor structured and arranged to convey a series of open containers along a lower horizontal path, each container having an open top end facing upward, the container conveyor further structured and arranged to momentarily bring each container in turn to a stop at an insertion station located along the lower horizontal path;

a container conveyor drive operable to drive the container conveyor;

a generally vertical inserter disposed above the insertion station, the inserter having an upper end and a lower end and an internal passage extending between the upper and lower ends for conducting a generally cup-shaped insert through the inserter and out the lower end into a container positioned at the insertion station;

an insert conveyor disposed above the inserter and structured and arranged to convey a series of inserts along an upper horizontal path, each insert on the insert conveyor having an open end and an opposite closed end and being in an inverted orientation such that the open end of the insert faces downward;

a tip-over mechanism adjacent a discharge end of the insert conveyor operable to cause a lead one of the inserts conveyed by the insert conveyor to tip over and fall into the inserter in an upright orientation;

an insert conveyor drive operable to drive the insert conveyor;

an insertion mechanism coupled with the inserter and structured and arranged to be controllably moved from a blocking position wherein the insertion mechanism prevents the insert from exiting through the lower end of the inserter, and a release position wherein the insert is allowed to move through the lower end of the inserter into a container at the insertion station; and a controller coupled with and coordinating operation of the container conveyor drive, the insert conveyor drive, and the insertion mechanism such that each insert delivered into the inserter is held therein until a container is moved by the container conveyor to the insertion station, whereupon the insertion mechanism allows the insert to fall into the container to form a container assembly.

2. The apparatus of claim 1, further comprising a container sensor system coupled with the controller and operable to detect a missing container condition in the container conveyor, the controller being operable, in response to detection of the missing container condition, to interrupt operation of the insert conveyor and the insertion mechanism until the missing container condition has been rectified.

3. The apparatus of claim 1, further comprising an insert sensor system coupled with the controller and operable to detect an abnormally positioned insert on the insert conveyor, and an insert removal device coupled with the controller and operable to remove the abnormally positioned insert from the insert conveyor, the controller being operable, in response to detection of the abnormally positioned insert, to operate the insert removal device to remove the abnormally positioned insert before said insert becomes the lead insert of the series.

4. The apparatus of claim 3, wherein the insert removal device comprises an air nozzle operable to direct a jet of air against the abnormally positioned insert to urge the insert out from the insert conveyor.

5. The apparatus of claim 1, wherein the tip-over mechanism includes an air nozzle for delivering a blast of air against the lead one of the inserts.

6. The apparatus of claim 5, further comprising a sensor for detecting presence of the lead one of the inserts in a position suitable to be tipped over by the tip-over mechanism, and a controllable valve connected with the air nozzle for supplying pressurized air to the air nozzle when the valve is opened in response to detection of an insert in said position.

7. The apparatus of claim 1, further comprising a container assembly sensor system coupled with the controller and operable to detect any unsatisfactory container assembly in the container conveyor downstream of the insertion station, and a container assembly removal device coupled with the controller and operable to remove an unsatisfactory container assembly from the container conveyor, the controller being operable, in response to detection of an unsatisfactory container assembly, to operate the container assembly removal device to remove the unsatisfactory container assembly from the container conveyor such that the unsatisfactory container assembly is prevented from advancing to a further downstream process for the container assemblies.

8. The apparatus of claim 7, wherein the container assembly removal device comprises an air nozzle operable to direct a jet of air against the unsatisfactory container assembly to urge said container assembly out from the container conveyor.

9. The apparatus of claim 1, wherein the container conveyor comprises a horizontal support plate upon which the containers are supported and advanced along, a container guide member positioned above the support plate and extending along the lower horizontal path, and a feed screw adjacent and parallel to the container guide member, the feed screw having helical flights such that a series of container-receiving pockets are defined between the helical flights and the container guide member, the feed screw being rotatably driven by the container conveyor drive such that containers disposed in the container-receiving pockets are advanced by the feed screw along the lower horizontal path to and past the insertion station.

10. The apparatus of claim 9, wherein the helical flights of the feed screw include a dwell portion configured to cause a container being advanced along the lower horizontal path to momentarily come to a stop at the insertion station for a predetermined period of time and then begin advancing again along the lower horizontal path while the feed screw continuously rotates.

11. The apparatus of claim 10, further comprising an encoder providing a signal to the controller indicating the rotational position of the feed screw, the controller controlling the rotational position of the feed screw based on said signal so as to coordinate positioning of a container at the inserter station with operation of the insertion mechanism.

12. The apparatus of claim 1, wherein the insert conveyor comprises a horizontal support plate upon which the inserts are supported and advanced along, an insert guide member positioned above the support plate and extending along the upper horizontal path, and a feed screw adjacent and parallel to the insert guide member, the feed screw having helical flights such that a series of insert-receiving pockets are defined between the helical flights and the insert guide member, the feed screw being rotatably driven by the insert conveyor drive such that inserts disposed in the insert-receiving pockets are advanced by the feed screw along the upper horizontal path to the tip-over mechanism.

13. The apparatus of claim 12, further comprising an encoder providing a signal to the controller indicating the rotational position of the feed screw, the controller controlling the rotational position of the feed screw based on said signal so as to coordinate delivery of an insert into the inserter station with operation of the insertion mechanism and container conveyor.

14. The apparatus of claim 1, wherein the inserter includes a first aperture through a side wall of the inserter into the internal passage, and the insertion mechanism comprises a first member that in the blocking position is extended through the first aperture into the internal passage to prevent an insert from exiting the lower end of the inserter, and in the release position is retracted from the internal passage to allow the insert to exit the inserter.

15. The apparatus of claim 14, wherein the insertion mechanism includes a first pneumatic cylinder controlled by the controller to move the first member between the blocking and release positions.

16. The apparatus of claim 15, wherein the inserter includes a second aperture through the side wall opposite from the first aperture, and the insertion mechanism includes a second member that in the blocking position is extended through the second aperture into the internal passage and in the release position is retracted from the internal passage, and a second pneumatic cylinder controlled by the controller to move the second member between the blocking and release positions, the first and second pneumatic cylinders being operated in unison to simultaneously extend both first and second members or retract both first and second members.

17. The apparatus of claim 1, wherein the insert conveyor further comprises a freely rotating wheel positioned adjacent a downstream end of the insert conveyor, the wheel including a plurality of radially outwardly extending arms spaced about a circumference of the wheel, each of the spaces between adjacent arms being configured for receiving an insert, the wheel effectively acting like a turnstile to enforce a certain amount of separation between the inserts being conveyed to the downstream end of the insert conveyor.

18. The apparatus of claim 1, further comprising a jam detector operable to detect a jam in the inserter.

19. A method for producing container assemblies, comprising:

conveying a series of open containers along a lower horizontal path, each container having an open top end facing upward, and momentarily bringing each container in turn to a stop at an insertion station located along the lower horizontal path;

providing a generally vertical inserter disposed above the insertion station, the inserter having an upper end and a lower end and an internal passage extending between the upper and lower ends for conducting a generally cup-shaped insert through the inserter and out the lower end into a container positioned at the insertion station;

conveying a series of inserts along an upper horizontal path above the inserter, each insert having an open end and an opposite closed end and being in an inverted orientation such that an open end of the insert faces downward;

causing a lead one of the inserts being conveyed along the upper horizontal path to tip over and fall by gravity into the inserter in an upright orientation;

preventing the insert from exiting through the lower end of the inserter as long as no container is positioned at the insertion station; and once a container is positioned at the insertion station, allowing the insert to move through the lower end of the inserter into the container to form a container assembly.

20. The method of claim 19, further comprising the steps of detecting a missing container condition in the series of containers being conveyed along the lower horizontal path, and interrupting the conveying of the series of inserts along the upper horizontal path until the missing container condition has been rectified.

21. The method of claim 19, further comprising the steps of detecting an abnormally positioned insert among the series of inserts being conveyed along the upper horizontal path, and removing the abnormally positioned insert from the upper horizontal path before said insert becomes the lead insert of the series.

22. The method of claim 19, further comprising the steps of detecting any unsatisfactory container assembly on the lower horizontal path downstream of the insertion station, and removing the unsatisfactory container assembly from the lower horizontal path such that the unsatisfactory container assembly is prevented from advancing to a further downstream process for the container assemblies.

23. The method of claim 19, wherein the containers are conveyed by a feed screw located adjacent and parallel to a container guide member that extends along the lower horizontal path, the feed screw having helical flights such that a series of container-receiving pockets are defined between the helical flights and the container guide member, the feed screw being rotatably driven such that containers disposed in the container-receiving pockets are advanced by the feed screw along the lower horizontal path to and past the insertion station.

* * * * *